US006053424A

United States Patent [19]

Gipson et al.

[11] Patent Number: 6,053,424

[45] **Date of Patent: *Apr. 25, 2000**

[54] APPARATUS AND METHOD FOR ULTRASONICALLY PRODUCING A SPRAY OF LIQUID

[75] Inventors: Lamar Heath Gipson, Acworth; Bernard Cohen, Berkeley Lake; Lee Kirby Jameson, Roswell, all of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/576,536

[22] Filed: Dec. 21, 1995

[51] Int. Cl.[7] ..... B05B 1/08

[52] U.S. Cl. ..... 239/102.2; 137/13; 137/828; 251/129.06

[58] Field of Search ..... 137/13, 827, 828; 251/129.06; 239/102.2

[56] References Cited

U.S. PATENT DOCUMENTS

| | | | |
|---|---|---|---|
| 3,016,599 | 1/1962 | Perry, Jr. | 28/78 |
| 3,042,481 | 7/1962 | Coggeshall | 18/54 |

(List continued on next page.)

FOREIGN PATENT DOCUMENTS

| | | |
|---|---|---|
| 9006657 | 7/1993 | Czechoslovakia . |
| 36617 | 9/1981 | European Pat. Off. . |
| 165407 | 12/1985 | European Pat. Off. . |
| 202100 | 11/1986 | European Pat. Off. . |
| 202381 | 11/1986 | European Pat. Off. . |
| 202844 | 11/1986 | European Pat. Off. . |
| 235603 | 9/1987 | European Pat. Off. . |
| 251524 | 1/1988 | European Pat. Off. . |
| 300198 | 1/1989 | European Pat. Off. . |
| 303998 | 2/1989 | European Pat. Off. . |

(List continued on next page.)

OTHER PUBLICATIONS

V.A. Wente, "Superfine Thermoplastic Fibers", *Industrial & Engineering Chemistry,* V.48, N. 8, Naval Research Laboratory, Washington, D.C., pp. 1342–1346.

Wente, Boone & Fluharty, "Manufacture of Superfine Organic Fibers", Naval Research Laboratory, Washington, D.C., NRL Report 4364 (111437), May 25, 1954.

Buntin & Lohkamp, "Melt Blowing–A One–Step Web Process for New Nonwoven Products", *TAPPI Journal,* V. 56, No. 4, pp. 74–77.

"Ultrasonics", *Encyclopedia of Chemical Technology,* 3rd Ed., V. 23, John Wiley & Sons, Inc., pp. 462–479.

"Degassing of Liquids", *Physical Principles of Ultrasonic Technology,* vol. 1, Plenum Press, 1973, pp. 381–509.

*Primary Examiner*—Andres Kashnikow
*Assistant Examiner*—Robin O. Evans
*Attorney, Agent, or Firm*—J. E. Ruland

[57] ABSTRACT

An apparatus and a method for ultrasonically producing a spray of liquid. The apparatus includes a die housing which defines a chamber adapted to receive a pressurized liquid and a means for applying ultrasonic energy to a portion of the pressurized liquid. The die housing further includes an inlet adapted to supply the chamber with the pressurized liquid, and an exit orifice defined by the walls of a die tip. The exit orifice is adapted to receive the pressurized liquid from the chamber and pass the liquid out of the die housing to produce a spray of liquid. When the means for applying ultrasonic energy is excited, it applies ultrasonic energy to the pressurized liquid without applying ultrasonic energy to the die tip. The method involves supplying a pressurized liquid to the foregoing apparatus, applying ultrasonic energy to the pressurized liquid but not the die tip while the exit orifice receives pressurized liquid from the chamber, and passing the pressurized liquid out of the exit orifice in the die tip to produce a spray of liquid.

38 Claims, 4 Drawing Sheets

U.S. PATENT DOCUMENTS

| | | | |
|---|---|---|---|
| 3,194,855 | 7/1965 | Jones et al. | 264/70 |
| 3,203,215 | 8/1965 | Jones | 72/253 |
| 3,233,012 | 2/1966 | Bodine | 264/23 |
| 3,285,442 | 11/1966 | Tigner | 264/70 |
| 3,341,394 | 9/1967 | Kinney | 161/72 |
| 3,463,321 | 8/1969 | Van Ingen | 210/388 |
| 3,619,429 | 11/1971 | Torigai et al. | 264/23 |
| 3,655,862 | 4/1972 | Dorschner et al. | 264/290 |
| 3,692,618 | 9/1972 | Dorschner et al. | 161/72 |
| 3,704,198 | 11/1972 | Prentice | 161/148 |
| 3,705,068 | 12/1972 | Dobo et al. | 156/441 |
| 3,715,104 | 2/1973 | Cottell | 259/1 R |
| 3,729,138 | 4/1973 | Tysk | 239/102 |
| 3,755,527 | 8/1973 | Keller et al. | 264/210 |
| 3,802,817 | 4/1974 | Matsuki et al. | 425/66 |
| 3,819,116 | 6/1974 | Goodinge et al. | 239/102 |
| 3,849,241 | 11/1974 | Butin et al. | 161/169 |
| 3,853,651 | 12/1974 | Porte | 156/73.6 |
| 3,884,417 | 5/1975 | Sheffield et al. | 239/102 |
| 3,949,938 | 4/1976 | Goodinge | 239/102 |
| 3,977,604 | 8/1976 | Yokoyama et al. | 239/102 |
| 3,978,185 | 8/1976 | Butin et al. | 264/93 |
| 4,013,223 | 3/1977 | Martin | 239/102 |
| 4,038,348 | 7/1977 | Kompanek | 261/36 A |
| 4,064,605 | 12/1977 | Akiyama et al. | 28/103 |
| 4,067,496 | 1/1978 | Martin | 239/102 |
| 4,091,140 | 5/1978 | Harmon | 428/288 |
| 4,100,319 | 7/1978 | Schwartz | 428/171 |
| 4,100,324 | 7/1978 | Anderson et al. | 428/288 |
| 4,100,798 | 7/1978 | Nilsson et al. | 73/194 E |
| 4,105,004 | 8/1978 | Asai et al. | 123/141 |
| 4,118,531 | 10/1978 | Hauser | 428/224 |
| 4,121,549 | 10/1978 | Martin et al. | 123/32 EA |
| 4,127,087 | 11/1978 | Caves | 123/32 AE |
| 4,159,703 | 7/1979 | Mayer | 123/139 |
| 4,239,720 | 12/1980 | Gerlach et al. | 264/147 |
| 4,340,563 | 7/1982 | Appel et al. | 264/518 |
| 4,372,491 | 2/1983 | Fishgal | 239/102 |
| 4,389,999 | 6/1983 | Jaqua | 123/536 |
| 4,405,297 | 9/1983 | Appel et al. | 425/72 |
| 4,418,672 | 12/1983 | Muller et al. | 123/478 |
| 4,434,204 | 2/1984 | Hartman et al. | 428/198 |
| 4,466,571 | 8/1984 | Muhlbauer | 239/101 |
| 4,496,101 | 1/1985 | Northman | 239/102 |
| 4,500,280 | 2/1985 | Astier et al. | 425/569 |
| 4,562,733 | 1/1986 | Lau | 264/12 |
| 4,563,993 | 1/1986 | Yamauchi et al. | 123/478 |
| 4,576,136 | 3/1986 | Yamauchi et al. | 123/590 |
| 4,590,915 | 5/1986 | Yamauchi et al. | 123/590 |
| 4,627,811 | 12/1986 | Greiser et al. | 425/72 |
| 4,644,045 | 2/1987 | Fowells | 526/348 |
| 4,663,220 | 5/1987 | Wisneski et al. | 428/221 |
| 4,665,877 | 5/1987 | Manaka et al. | 123/472 |
| 4,715,353 | 12/1987 | Koike et al. | 123/590 |
| 4,716,879 | 1/1988 | Takayama et al. | 123/590 |
| 4,726,522 | 2/1988 | Kokubo et al. | 239/102.2 |
| 4,726,523 | 2/1988 | Kokubo et al. | 239/102.2 |
| 4,726,524 | 2/1988 | Ishikawa et al. | 239/102.2 |
| 4,726,525 | 2/1988 | Yonekawa et al. | 239/102.2 |
| 4,742,810 | 5/1988 | Anders et al. | 123/538 |
| 4,756,478 | 7/1988 | Endo et al. | 239/102.2 |
| 4,793,954 | 12/1988 | Lee et al. | 264/23 |
| 4,815,192 | 3/1989 | Usui et al. | 29/509 |
| 4,852,668 | 8/1989 | Dickinson, III et al. | 175/67 |
| 4,974,780 | 12/1990 | Nakamura et al. | 239/102.2 |
| 4,986,248 | 1/1991 | Kobayaski et al. | 123/590 |
| 4,995,367 | 2/1991 | Yamauchi et al. | 123/494 |
| 5,017,311 | 5/1991 | Furusawa et al. | 264/23 |
| 5,068,068 | 11/1991 | Furusawa et al. | 264/23 |
| 5,110,286 | 5/1992 | Gaysert et al. | 431/208 |
| 5,154,347 | 10/1992 | Vijay | 239/4 |
| 5,160,746 | 11/1992 | Dodge, II et al. | 425/7 |
| 5,169,067 | 12/1992 | Matsusaka et al. | 239/102.2 |
| 5,179,923 | 1/1993 | Tsurutani et al. | 123/435 |
| 5,226,364 | 7/1993 | Fadner | 101/366 |
| 5,269,981 | 12/1993 | Jameson et al. | 264/23 |
| 5,330,100 | 7/1994 | Malinowski | 239/102.2 |
| 5,803,106 | 9/1998 | Cohen et al. | 137/13 |

FOREIGN PATENT DOCUMENTS

| | | |
|---|---|---|
| 495506 | 7/1992 | European Pat. Off. . |
| 0644280 | 3/1995 | European Pat. Off. . |
| 2555839 | 6/1976 | Germany . |
| 2734818 | 8/1976 | Germany . |
| 134052 | 2/1979 | Germany . |
| 138523 | 11/1979 | Germany . |
| 3010985 | 10/1981 | Germany . |
| 3912524 | 11/1989 | Germany . |
| 49-133613 | 12/1974 | Japan . |
| 56-144214 | 11/1981 | Japan . |
| 57-51441 | 3/1982 | Japan . |
| 57-078967 | 5/1982 | Japan . |
| 57-099327 | 9/1982 | Japan . |
| 386977 | 5/1972 | Russian Federation . |
| 468948 | 7/1975 | Russian Federation . |
| 449504 | 10/1975 | Russian Federation . |
| 532529 | 5/1977 | Russian Federation . |
| 706250 | 12/1979 | Russian Federation . |
| 1812332 | 4/1993 | Russian Federation . |
| 865707 | 4/1961 | United Kingdom . |
| 1382828 | 2/1975 | United Kingdom . |
| 1415539 | 11/1975 | United Kingdom . |
| 1432760 | 4/1976 | United Kingdom . |
| 1555766 | 11/1979 | United Kingdom . |
| 2077351 | 12/1981 | United Kingdom . |
| 2082251 | 3/1982 | United Kingdom . |
| 2274877 | 8/1994 | United Kingdom . |
| 9301404 | 1/1993 | WIPO . |
| 9600318 | 1/1996 | WIPO . |

APPARATUS AND METHOD FOR ULTRASONICALLY PRODUCING A SPRAY OF LIQUID

BACKGROUND OF THE INVENTION

The present invention relates to a method of forming a spray of liquid. The present invention also relates to an apparatus for forming a spray of liquid.

Ultrasonic spray equipment is known. Examples include molding equipment, humidifiers and medical nebulizers. In some conventional devices, a pressurized stream of liquid is directed against an ultrasonically vibrating surface to produce a highly atomized spray of liquid. In other conventional devices, a spray nozzle or airblast atomizer may be ultrasonically vibrated to enhance spray formation. Generally speaking, devices of this type are configured such that the operating passage or orifice through which liquid flows is sonically live or vibrated. Utilizing spray equipment with a sonically live operating passage or orifice can add complexity to the design and operation of the equipment. For example, the dimensions of the operating passage, nozzle and supports need to be taken into consideration when determining energization frequencies and power requirements. As another example, some applications may require isolation of the sonically live operating passage from other non-vibrating elements of the equipment. Contact between the sonically live operating passage and a non-vibrating element may interfere with or interrupt operation.

SUMMARY OF THE INVENTION

The present invention provides an apparatus and a method for producing a liquid spray by applying ultrasonic energy to a portion of a pressurized liquid as it is received in a chamber and then passed through an orifice.

The apparatus includes a die housing which defines a chamber adapted to receive a pressurized liquid and a means for applying ultrasonic energy to a portion of the pressurized liquid. The die housing includes a chamber adapted to receive the pressurized liquid, an inlet adapted to supply the chamber with the pressurized liquid, and an exit orifice (or a plurality of exit orifices) defined by the walls of a die tip, the exit orifice being adapted to receive the pressurized liquid from the chamber and pass the liquid out of the die housing. Generally speaking, the means for applying ultrasonic energy is located within the chamber. For example, the means for applying ultrasonic energy may be an immersed ultrasonic horn. According to the invention, the means for applying ultrasonic energy is located within the chamber in a manner such that no ultrasonic energy is applied to the die tip (i.e., the walls of the die tip defining the exit orifice). That is, the means for applying ultrasonic energy is located within the chamber in a manner such that substantially no ultrasonic energy is applied to the die tip.

In one embodiment of the present invention, the die housing may have a first end and a second end. One end of the die housing forms a die tip having walls that define an exit orifice which is adapted to receive a pressurized liquid from the chamber and pass the pressurized liquid along a first axis. The means for applying ultrasonic energy to a portion of the pressurized liquid is an ultrasonic horn having a first end and a second end. The horn is adapted, upon excitation by ultrasonic energy, to have a node and a longitudinal mechanical excitation axis. The horn is located in the second end of the die housing in a manner such that the first end of the horn is located outside of the die housing and the second end is located inside the die housing, within the chamber, and is in close proximity to the exit orifice.

The longitudinal excitation axis of the ultrasonic horn desirably will be substantially parallel with the first axis. Furthermore, the second end of the horn desirably will have a cross-sectional area approximately the same as or greater than a minimum area which encompasses all exit orifices in the die housing. Upon excitation by ultrasonic energy, the ultrasonic horn is adapted to apply ultrasonic energy to the pressurized liquid within the chamber (defined by the die housing) but not to the die tip which has walls that define the exit orifice.

The present invention contemplates the use of an ultrasonic horn having a vibrator means coupled to the first end of the horn. The vibrator means may be a piezoelectric transducer or a magnetostrictive transducer. The transducer may be coupled directly to the horn or by means of an elongated waveguide. The elongated waveguide may have any desired input:output mechanical excitation ratio, although ratios of 1:1 and 1:1.5 are typical for many applications. The ultrasonic energy typically will have a frequency of from about 15 kHz to about 500 kHz, although other frequencies are contemplated.

According to the present invention, the ultrasonic horn may be composed of a magnetostrictive material. The horn may be surrounded by a coil (which may be immersed in the liquid) capable of inducing a signal into the magnetostrictive material causing it to vibrate at ultrasonic frequencies. In such cases, the ultrasonic horn can simultaneously be the transducer and the means for applying ultrasonic energy to the liquid.

In an aspect of the present invention, the exit orifice may have a diameter of less than about 0.1 inch (2.54 mm). For example, the exit orifice may have a diameter of from about 0.0001 to about 0.1 inch (0.00254 to 2.54 mm) As a further example, the exit orifice may have a diameter of from about 0.001 to about 0.01 inch (0.0254 to 0.254 mm).

According to the invention, the exit orifice may be a single exit orifice or a plurality of exit orifices. The exit orifice may be an exit capillary. The exit capillary may have a length to diameter ratio (L/D ratio) of ranging from about 4:1 to about 10:1. Of course, the exit capillary may have a L/D ratio of less than 4:1 or greater than 10:1.

In an embodiment of the invention, the exit orifice is self-cleaning even as it is adapted to produce a spray of liquid. According to the invention, the apparatus may be adapted to produce an atomized spray of liquid. Alternatively and/or additionally, the apparatus may be adapted to produce a uniform, cone-shaped spray of liquid.

The present invention encompasses a method of producing a liquid spray. The method involves supplying a pressurized liquid to the apparatus described above, exciting the means for applying ultrasonic energy with ultrasonic energy while the exit orifice receives pressurized liquid from the chamber (without applying ultrasonic energy to the die tip), and passing the pressurized liquid out of the exit orifice in the die tip to produce a liquid spray. That is, the exit orifice is adapted to produce a spray of liquid when the means for applying ultrasonic energy is excited with ultrasonic energy while the exit orifice receives pressurized liquid from the chamber and passes the liquid out of the die housing.

The present invention contemplates that the method steps of exciting the means for applying ultrasonic energy with ultrasonic energy (i.e., exciting the ultrasonic horn) while the exit orifice receives pressurized liquid from the chamber and passing the liquid out of the exit orifice in the die tip may further include the step of self-cleaning the exit orifice. The present invention contemplates that the step of passing the liquid out of the exit orifice in the die tip to produce a spray of liquid may include steps intended to produce sprays of liquid including, but not limited to, an atomized spray of liquid and a uniform, cone-shaped spray of liquid.

The apparatus and method of the present invention provide an advantage in that relatively viscous liquids (i.e., relatively viscous when compared to water, gasoline or diesel fuel at normal room temperature and pressures) can be readily sprayed or atomized from a coherent stream without conventional atomizing spray nozzles, air jets, rotating and/or vibrating impingement plates or the like. Utilizing the apparatus and method of the present invention, pressurized streams of liquid that are normally coherent in the absence of conventional atomizing or spray devices can be sprayed or atomized without directly changing or vibrating the operational orifice, capillary or nozzle (i.e., exit orifice), simply by applying ultrasonic energy to the ultrasonic horn (i.e., exciting the ultrasonic horn). If the ultrasonic energy is removed, spray formation or atomization will stop and a coherent stream will again flow from the orifice.

The apparatus and method of the present invention can also provide advantages in spraying operations by providing a degree of control over the spray including, but not limited to, such characteristics as the droplet size, the uniformity of the droplet size, the shape of the spray pattern and/or the uniformity of the spray density. Furthermore, the apparatus and method of the present invention can be used to break up a coherent stream of liquid in the absence of conventional atmospheric conditions. For example, it is contemplated that the apparatus and method of the present invention may be used to create a spray of liquid droplets without under very low pressure conditions or under a vacuum.

DETAILED DESCRIPTION OF THE INVENTION

As used herein, the term "liquid" refers to an amorphous (noncrystalline) form of matter intermediate between gases and solids, in which the molecules are much more highly concentrated than in gases, but much less concentrated than in solids. A liquid may have a single component or may be made of multiple components. The components may be other liquids, solids and/or gases. For example, characteristic of liquids is their ability to flow as a result of an applied force. Liquids that flow immediately upon application of force and for which the rate of flow is directly proportional to the force applied are generally referred to as Newtonian liquids. Some liquids have abnormal flow response when force is applied and exhibit non-Newtonian flow properties.

As used herein, the term "node" means the point on the longitudinal excitation axis of the ultrasonic horn at which no longitudinal motion of the horn occurs upon excitation by ultrasonic energy. The node sometimes is referred in the art, as well as in this specification, as the nodal point.

The term "close proximity" is used herein in a qualitative sense only. That is, the term is used to mean that the means for applying ultrasonic energy is sufficiently close to the exit orifice (e.g., extrusion orifice) to apply the ultrasonic energy primarily to the liquid (e.g., molten thermoplastic polymer) passing into the exit orifice (e.g., extrusion orifice). The term is not used in the sense of defining specific distances from the extrusion orifice.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, solvents, particulates and materials added to enhance processability of the composition.

Generally speaking, the apparatus of the present invention includes a die housing and a means for applying ultrasonic energy to a portion of a pressurized liquid (e.g., a molten thermoplastic polymers, hydrocarbon oils, water, slurries, suspensions or the like). The die housing defines a chamber adapted to receive the pressurized liquid, an inlet (e.g., inlet orifice) adapted to supply the chamber with the pressurized liquid, and an exit orifice (e.g., extrusion orifice) adapted to receive the pressurized liquid from the chamber and pass the liquid out of the exit orifice of the die housing. The means for applying ultrasonic energy is located within the chamber. For example, the means for applying ultrasonic energy can be located partially within the chamber or the means for applying ultrasonic energy can be located entirely within the chamber.

Figure 1:
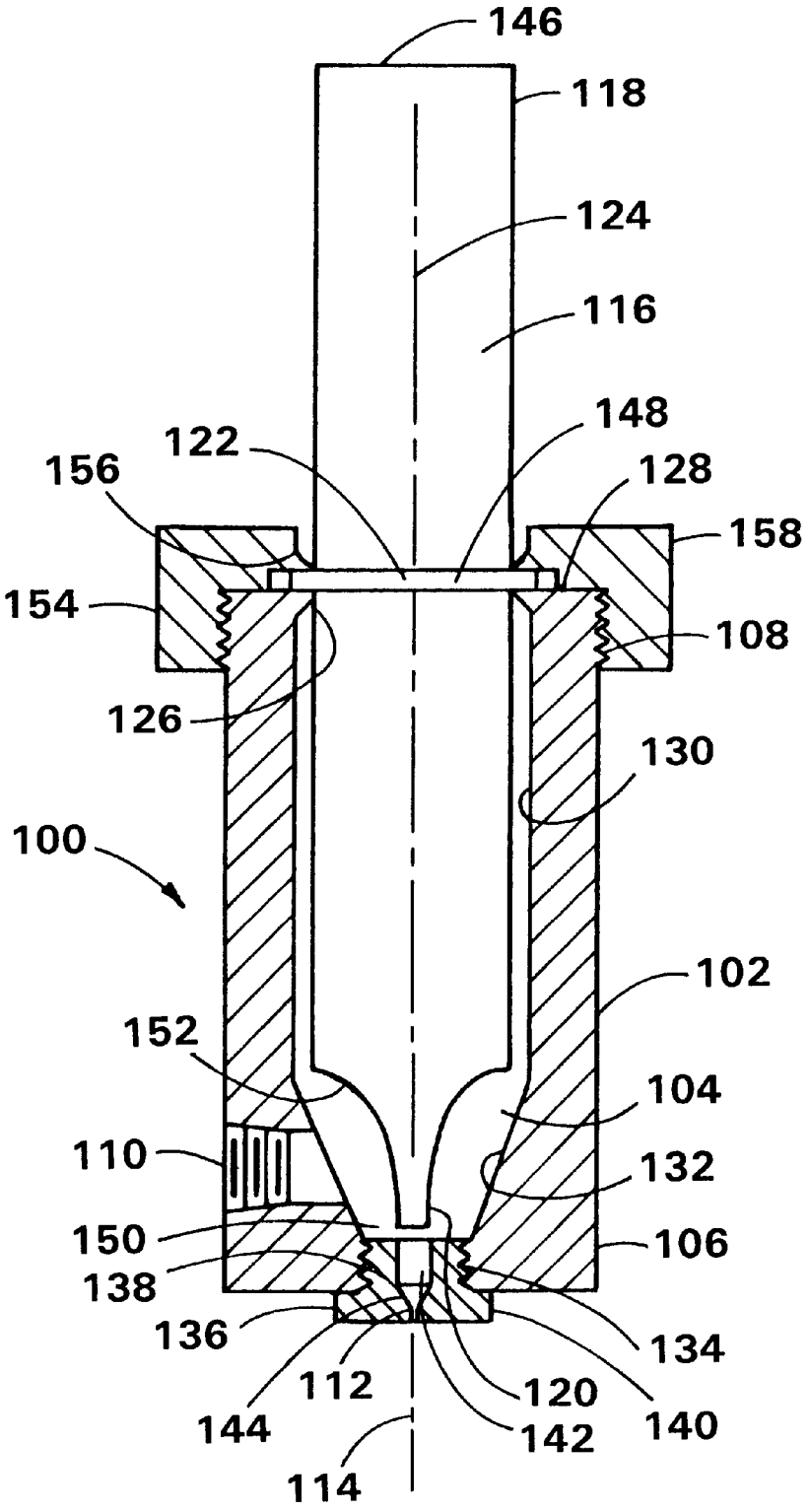
FIG. 1 is a diagrammatic cross-sectional representation of one embodiment of the apparatus of the present invention.

Referring now to FIG. 1, there is shown, not necessarily to scale, an exemplary apparatus for increasing the flow rate of a pressurized liquid through an orifice. The apparatus 100 includes a die housing 102 which defines a chamber 104 adapted to receive a pressurized liquid (e.g., oil, water, molten thermoplastic polymer, syrup or the like). The die housing 102 has a first end 106 and a second end 108. The die housing 102 also has an inlet 110 (e.g., inlet orifice) adapted to supply the chamber 104 with the pressurized liquid. An exit orifice 112 (which may also be referred to as an extrusion orifice) is located in the first end 106 of the die housing 102; it is adapted to receive the pressurized liquid from the chamber 104 and pass the liquid out of the die housing 102 along a first axis 114. An ultrasonic horn 116 is located in the second end 108 of the die housing 102. The ultrasonic horn has a first end 118 and a second end 120. The horn 116 is located in the second end 108 of the die housing 102 in a manner such that the first end 118 of the horn 116 is located outside of the die housing 102 and the second end 120 of the horn 116 is located inside the die housing 102, within the chamber 104, and is in close proximity to the exit orifice 112. The horn 116 is adapted, upon excitation by ultrasonic energy, to have a nodal point 122 and a longitudinal mechanical excitation axis 124. Desirably, the first axis 114 and the mechanical excitation axis 124 will be substantially parallel. More desirably, the first axis 114 and the mechanical excitation axis 124 will substantially coincide, as shown in FIG. 1.

The size and shape of the apparatus of the present invention can vary widely, depending, at least in part, on the number and arrangement of exit orifices (e.g., extrusion orifices) and the operating frequency of the means for applying ultrasonic energy. For example, the die housing may be cylindrical, rectangular, or any other shape. Moreover, the die housing may have a single exit orifice or a plurality of exit orifices. A plurality of exit orifices may be arranged in a pattern, including but not limited to, a linear or a circular pattern.

The means for applying ultrasonic energy is located within the chamber, typically at least partially surrounded by the pressurized liquid. Such means is adapted to apply the ultrasonic energy to the pressurized liquid as it passes into the exit orifice. Stated differently, such means is adapted to apply ultrasonic energy to a portion of the pressurized liquid in the vicinity of each exit orifice. Such means may be located completely or partially within the chamber.

When the means for applying ultrasonic energy is an ultrasonic horn, the horn conveniently extends through the die housing, such as through the first end of the housing as identified in FIG. 1. However, the present invention comprehends other configurations. For example, the horn may extend through a wall of the die housing, rather than through an end. Moreover, neither the first axis nor the longitudinal excitation axis of the horn need to be vertical. If desired, the longitudinal mechanical excitation axis of the horn may be at an angle to the first axis. Nevertheless, the longitudinal mechanical excitation axis of the ultrasonic horn desirably will be substantially parallel with the first axis. More desirably, the longitudinal mechanical excitation axis of the ultrasonic horn desirably and the first axis will substantially coincide, as shown in FIG. 1.

If desired, more than one means for applying ultrasonic energy may be located within the chamber defined by the die housing. Moreover, a single means may apply ultrasonic energy to the portion of the pressurized liquid which is in the vicinity of one or more exit orifices.

According to the present invention, the ultrasonic horn may be composed of a magnetostrictive material. The horn may be surrounded by a coil (which may be immersed in the liquid) capable of inducing a signal into the magnetostrictive material causing it to vibrate at ultrasonic frequencies. In such cases, the ultrasonic horn can simultaneously be the transducer and the means for applying ultrasonic energy to the multi-component liquid.

The application of ultrasonic energy to a plurality of exit orifices may be accomplished by a variety of methods. For example, with reference again to the use of an ultrasonic horn, the second end of the horn may have a cross-sectional area which is sufficiently large so as to apply ultrasonic energy to the portion of the pressurized liquid which is in the vicinity of all of the exit orifices in the die housing. In such case, the second end of the ultrasonic horn desirably will have a cross-sectional area approximately the same as or greater than a minimum area which encompasses all exit orifices in the die housing (i.e., a minimum area which is the same as or greater than the sum of the areas of the exit orifices in the die housing originating in the same chamber). Alternatively, the second end of the horn may have a plurality of protrusions, or tips, equal in number to the number of exit orifices. In this instance, the cross-sectional area of each protrusion or tip desirably will be approximately the same as or less than the cross-sectional area of the exit orifice with which the protrusion or tip is in close proximity.

The planar relationship between the second end of the ultrasonic horn and an array of exit orifices may also be shaped (e.g., parabolically, hemispherically, or provided with a shallow curvature) to provide or correct for certain spray patterns.

As already noted, the term "close proximity" is used herein to mean that the means for applying ultrasonic energy is sufficiently close to the exit orifice to apply the ultrasonic energy primarily to the pressurized liquid passing into the exit orifice. The actual distance of the means for applying ultrasonic energy from the exit orifice in any given situation will depend upon a number of factors, some of which are the flow rate of the pressurized liquid (e.g., the melt flow rate of a molten thermoplastic polymer or the viscosity of a liquid), the cross-sectional area of the end of the means for applying the ultrasonic energy relative to the cross-sectional area of the exit orifice, the frequency of the ultrasonic energy, the gain of the means for applying the ultrasonic energy (e.g., the magnitude of the longitudinal mechanical excitation of the means for applying ultrasonic energy), the temperature of the pressurized liquid, and the rate at which the liquid passes out of the exit orifice.

In general, the distance of the means for applying ultrasonic energy from the exit orifice in a given situation may be determined readily by one having ordinary skill in the art without undue experimentation. In practice, such distance will be in the range of from about 0.002 inch (about 0.05 mm) to about 1.3 inches (about 33 mm), although greater distances can be employed. Such distance determines the extent to which ultrasonic energy is applied to the pressurized liquid other than that which is about to enter the exit orifice; i.e., the greater the distance, the greater the amount of pressurized liquid which is subjected to ultrasonic energy. Consequently, shorter distances generally are desired in order to minimize degradation of the pressurized liquid and other adverse effects which may result from exposure of the liquid to the ultrasonic energy.

One advantage of the apparatus of the present invention is that it is self-cleaning. That is, the combination of supplied pressure and forces generated by ultrasonically exciting the means for supplying ultrasonic energy to the pressurized liquid (without applying ultrasonic energy directly to the orifice) can remove obstructions that appear to block the exit orifice (e.g., extrusion orifice). According to the invention, the exit orifice is adapted to be self-cleaning when the means for applying ultrasonic energy is excited with ultrasonic energy (without applying ultrasonic energy directly to the orifice) while the exit orifice receives pressurized liquid from the chamber and passes the liquid out of the die housing. Desirably, the means for applying ultrasonic energy is an immersed ultrasonic horn having a longitudinal mechanical excitation axis and in which the end of the horn located in the die housing nearest the orifice is in close proximity to the exit orifice but does not apply ultrasonic energy directly to the exit orifice.

The present invention encompasses a method of self-cleaning an exit orifice of a die assembly. The method includes the steps of supplying a pressurized liquid to the die assembly described above; exciting means for applying ultrasonic energy (located within the die assembly) with ultrasonic energy while the exit orifice receives pressurized liquid from the chamber without applying ultrasonic energy directly to the exit orifice; and passing the pressurized liquid out of the exit orifice in the die tip to remove obstructions that would block the exit orifice so that the exit orifice is cleaned.

The present invention covers an apparatus for producing a spray of liquid. Generally speaking, the spray-producing apparatus has the configuration of the apparatus described above and the exit orifice is adapted to produce a spray of liquid when the means for applying ultrasonic energy is excited with ultrasonic energy while the exit orifice receives pressurized liquid from the chamber and passes the liquid out of the exit orifice in the die tip. The apparatus may be adapted to provide an atomized spray of liquid (i.e., a very fine spray or spray of very small droplets). The apparatus may be adapted to produce a uniform, cone-shaped spray of liquid. For example, the apparatus may be adapted to produce a cone-shaped spray of liquid having a relatively uniform density or distribution of droplets throughout the cone-shaped spray. Alternatively, the apparatus may be adapted to produce irregular patterns of spray and/or irregular densities or distributions of droplets throughout the cone-shaped spray.

The present invention also includes a method of producing a spray of liquid. The method includes the steps of supplying a pressurized liquid to the die assembly described above; exciting means for applying ultrasonic energy (located within the die assembly) with ultrasonic energy while the exit orifice receives pressurized liquid from the chamber without applying ultrasonic energy directly to the exit orifice; and passing the liquid out of the exit orifice in the die tip to produce a spray of liquid. According to the method of the invention, the conditions may be adjusted to produce an atomized spray of liquid, a uniform, cone-shaped spray, irregularly patterned sprays and/or sprays having irregular densities.

The apparatus and method of the present invention can also provide advantages in continuous and intermittent spraying operations such as, for example, spray drying, spray cooling, spray reactions, atomized suspension techniques, powdered metals, agricultural spraying, paint spraying, surface treatment, insulation/fibers and coating materials, snow making spray machines, spray humidifiers, mist sprays, air and gas washing and scrubbing or the like. The present invention can provide a degree of control over the spray including, but not limited to, such characteristics as the droplet size, the uniformity of the droplet size, the shape of the spray pattern and/or the uniformity of the spray density.

The present invention is further described by the examples which follow. Such examples, however, are not to be construed as limiting in any way either the spirit or the scope of the present invention.

EXAMPLES

Ultrasonic Horn Apparatus

The following is a description of an exemplary ultrasonic horn apparatus of the present invention generally as shown in FIG. 1.

With reference to FIG. 1, the die housing 102 of the apparatus was a cylinder having an outer diameter of 1.375 inches (about 34.9 mm) , an inner diameter of 0.875 inch (about 22.2 mm), and a length of 3.086 inches (about 78.4 mm). The outer 0.312-inch (about 7.9-mm) portion of the second end 108 of the die housing was threaded with 16-pitch threads. The inside of the second end had a beveled edge 126, or chamfer, extending from the face 128 of the second end toward the first end 106 a distance of 0.125 inch (about 3.2 mm). The chamfer reduced the inner diameter of the die housing at the face of the second end to 0.75 inch (about 19.0 mm). An inlet 110 (also called an inlet orifice) was drilled in the die housing, the center of which was 0.688 inch (about 17.5 mm) from the first end, and tapped. The inner wall of the die housing consisted of a cylindrical portion 130 and a conical frustrum portion 132. The cylindrical portion extended from the chamfer at the second end toward the first end to within 0.992 inch (about 25.2 mm) from the face of the first end. The conical frustrum portion extended from the cylindrical portion a distance of 0.625 inch (about 15.9 mm), terminating at a threaded opening 134 in the first end. The diameter of the threaded opening was 0.375 inch (about 9.5 mm); such opening was 0.367 inch (about 9.3 mm) in length.

A die tip 136 was located in the threaded opening of the first end. The die tip consisted of a threaded cylinder 138 having a circular shoulder portion 140. The shoulder portion was 0.125 inch (about 3.2 mm) thick and had two parallel faces (not shown) 0.5 inch (about 12.7 mm) apart. An exit orifice 112 (also called an extrusion orifice) was drilled in the shoulder portion and extended toward the threaded portion a distance of 0.087 inch (about 2.2 mm). The diameter of the extrusion orifice was 0.0145 inch (about 0.37 mm). The extrusion orifice terminated within the die tip at a vestibular portion 142 having a diameter of 0.125 inch (about 3.2 mm) and a conical frustrum portion 144 which joined the vestibular portion with the extrusion orifice. The wall of the conical frustrum portion was at an angle of 30° from the vertical. The vestibular portion extended from the extrusion orifice to the end of the threaded portion of the die tip, thereby connecting the chamber defined by the die housing with the extrusion orifice.

The means for applying ultrasonic energy was a cylindrical ultrasonic horn 116. The horn was machined to resonate at a frequency of 20 kHz. The horn had a length of 5.198 inches (about 132.0 mm), which was equal to one-half of the resonating wavelength, and a diameter of 0.75 inch (about 19.0 mm). The face 146 of the first end of the horn was drilled and tapped for a ⅜-inch (about 9.5-mm) stud (not shown). The horn was machined with a collar 148 at the nodal point 122. The collar was 0.094-inch (about 2.4-mm) wide and extended outwardly from the cylindrical surface of the horn 0.062 inch (about 1.6 mm). Thus, the diameter of the horn at the collar was 0.875 inch (about 22.2 mm). The second end 120 of the horn terminated in a small cylindrical tip 150 0.125 inch (about 3.2 mm) long and 0.125 inch (about 3.2 mm) in diameter. Such tip was separated from the cylindrical body of the horn by a parabolic frustrum portion 152 approximately 0.5 inch (about 13 mm) in length. That is, the curve of this frustrum portion as seen in cross-section was parabolic in shape. The face of the small cylindrical tip was normal to the cylindrical wall of the horn and was located about 0.4 inch (about 10 mm) from the extrusion orifice. Thus, the face of the tip of the horn, i.e., the second end of the horn, was located immediately above the vestibular opening in the threaded end of the die tip.

The first end 108 of the die housing was sealed by a threaded cap 154 which also served to hold the ultrasonic horn in place. The threads extended upwardly toward the top of the cap a distance of 0.312 inch (about 7.9 mm). The outside diameter of the cap was 2.00 inches (about 50.8 mm) and the length or thickness of the cap was 0.531 inch (about 13.5 mm). The opening in the cap was sized to accommodate the horn; that is, the opening had a diameter of 0.75 inch (about 19.0 mm). The edge of the opening in the cap was a chamfer 156 which was the mirror image of the chamfer at the second end of the die housing. The thickness of the cap at the chamfer was 0.125 inch (about 3.2 mm), which left a space between the end of the threads and the bottom of the chamfer of 0.094 inch (about 2.4 mm), which space was the same as the length of the collar on the horn. The diameter of such space was 1.104 inch (about 28.0 mm). The top 158 of the cap had drilled in it four ¼-inch diameter×¼-inch deep holes (not shown) at 90° intervals to accommodate a pin spanner. Thus, the collar of the horn was compressed between the two chamfers upon tightening the cap, thereby sealing the chamber defined by the die housing.

A Branson elongated aluminum waveguide having an input:output mechanical excitation ratio of 1:1.5 was coupled to the ultrasonic horn by means of a ⅜-inch (about 9.5-mm) stud. To the elongated waveguide was coupled a piezoelectric transducer, a Branson Model 502 Converter, which was powered by a Branson Model 1120 Power Supply operating at 20 kHz (Branson Sonic Power Company, Danbury, Connecticut). Power consumption was monitored with a Branson Model A410A Wattmeter.

Example 1

This example illustrates the ability of the apparatus of the present invention to remove obstructions which block the extrusion orifice. In this example, a Grid Melter hopper connected to the apparatus of the present invention was filled with a quantity of an experimental pressure-sensitive hot melt adhesive, HL-1295 ZP, obtained from the H. B. Fuller Company of St. Paul, Minn. The recommended application temperature for the resin was 149° C. Heat zones in the melter, tubing, and die housing initially were set at 138° C. When heat levels stabilized, the pump drive was started at about 15 percent of total speed, and a pressure of 450 psig was developed. No ultrasonic power was used at this point. The temperature of all zones then was increased to approximately 194° C., or 27° C. above the recommended application temperature of the resin. The extrusion pressure stabilized at about 130 psig. The extrudate at this point smelled burned and was smoking. Within five minutes the flow stopped, and the extrusion pressure rose to over 400 psig. At this point the ultrasonic power controller was set to 50 percent and the power was turned on for one second. Flow immediately resumed and the pressure dropped to about 130 psig. Particles of black charred materials could be seen in the extrudate. Within three minutes the flow stopped again and was restarted with an application of ultrasonic energy as before. This cycle was repeated eight more times. After each repetition the power control was turned down slightly; after the last cycle the power control setting was at 30 percent power, which resulted in a wattmeter reading of 35 watts. The power supply was left on at the 30 percent level and flow observed for one hour. Charred particles could be seen within the extrudate, but flow was uninterrupted for the course of the trial.

Example 2

This example illustrates the present invention as it relates to producing a spray of liquid utilizing the ultrasonic apparatus of the present invention. Piping on the high pressure side of the system was ¼" stainless steel tubing. The capillary tip had an orifice opening of 0.0145 inch in diameter and a capillary length of 0.087 inch. Accordingly, the capillary had a length to diameter ratio (L/D) of 6. The opening on the tip opposite the capillary was 0.125 inch in diameter. The walls of the opening narrowed at an angle of 30 degrees until the opening was at the appropriate capillary diameter.

The ultrasonic device was powered by the Branson model 1120 power supply. Power consumed was monitored by the Branson A410A wattmeter. The 20 KHz ultrasonic signal was converted by a Branson model 502 converter. The output of the converter was coupled through an aluminum 1:1 booster to the ported horn. The converter, booster, and horn constituted the ultrasonic stack.

A Branson model J-4 power controller was installed to control the output of the power supply in percentage of maximum power capacity.

Two different orifices were used. One had a diameter of 0.004 inch and a length of 0.004 inch (L/D ratio of 1) and the other had a diameter of 0.010 and a length of 0.006 inch (L/D ratio of 0.006/0.010 or 0.6).

The oil used was a vacuum pump oil having the designation HE-200, Catalog # 98-198-006 available from Legbold-Heraeus Vacuum Products, Inc. of Export, Pa. The trade literature reported that the oil had a kinematic viscosity of 58.1 centipoise (cP) at 104° Fahrenheit and a kinematic viscosity of 9.14 cP at 212° Fahrenheit Flow rate trials were conducted on the immersed horn with the various tips without ultrasonic power, at 80 watts of power, and at 90 watts of power. Results of the trials are shown in Table 1. In Table 1, the "Pressure" column is the pressure in psig, the "TIP" column refers to the diameter and the length of the capillary tip (i.e., the exit orifice) in inches, the "Power" column refers to power consumption in watts at a given power setting, and the "Rate" column refers to the flow rate measured for each trial, expressed in g/min.

The temperature of the extrudate was monitored by placing a bare junction thermocouple in the stream within ½" of the exit, and reading the signal from the thermocouple with a hand-held pyrometer.

In every trial when the ultrasonic device was powered, the oil stream instantly atomized into a uniform, cone-shaped spray of fine droplets.

TABLE 1

Vacuum Pump Oil HE-200

| Pressure | Capillary Tip Diameter × Length (inches) | | Power | Rate |
|---|---|---|---|---|
| 150 | 0.004 | 0.004 | 0 | 11.8 |
| 150 | | | 80 | 12.6 |
| 150 | | | 90 | 16.08 |
| 250 | 0.004 | 0.004 | 0 | 13.32 |
| 250 | | | 80 | 14.52 |
| 250 | | | 90 | 17.16 |
| 150 | 0.010 | 0.006 | 0 | 20.76 |
| 150 | | | 80 | 22.08 |
| 150 | | | 90 | 25.80 |
| 250 | 0.10 | 0.006 | 0 | 24.00 |
| 250 | | | 80 | 28.24 |
| 250 | | | 90 | 31.28 |

Example 3

The procedure used for Examples 1 and 2 was used to produce a spray of two different types of hydraulic oils (EP Hydraulic Oil 68 and EP Hydraulic Oil 32). The heavier oil was EP Hydraulic Oil 68 (61.3–72.3 cSt at 100 deg F) from Motor Oil, Inc. of Elk Grove Village, Ill. The lighter oil was EP Hydraulic Oil 32 (28.55–35.20 cSt at 100 deg F) from Motor Oil, Inc. of Elk Grove Village, Ill.

Figure 6:
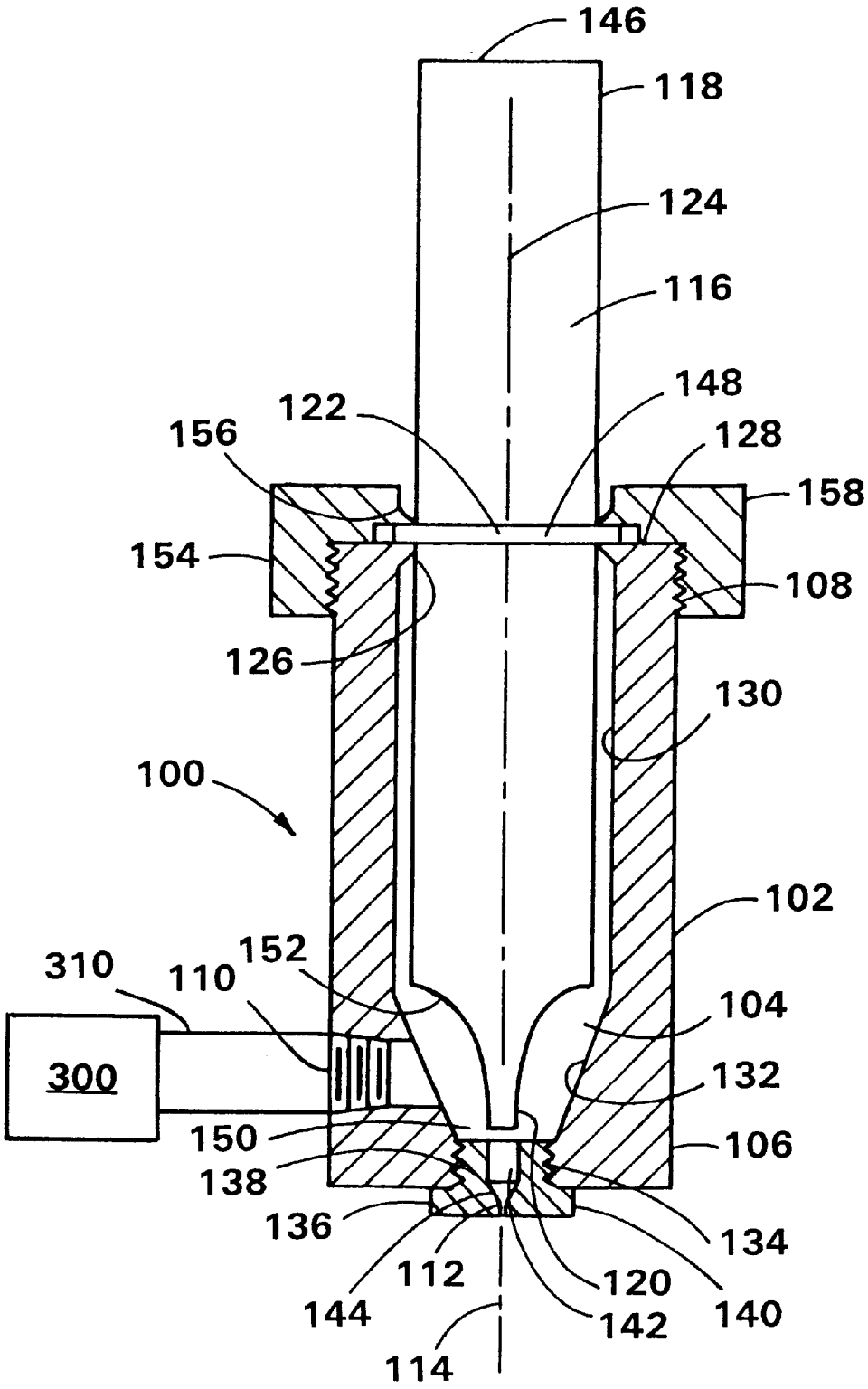
FIG. 6 is a diagrammatic cross-sectional representation of a further embodiment of the apparatus of the present invention.

The hydraulic oils were pumped with the Dayton pumping system schematically shown at 300 in FIG. 6. As shown, Dayton pumping system 300 is in communication with inlet 110 through piping 310. 0.010", and 0.004"×0.006". A wider range of pressures was also used, from 200–700 psig in increments of 100 psig. The pressure was maintained throughout each trial. If necessary, the pressure was adjusted after the ultrasound was applied to maintain a constant pressure. Flow rates were determined by weighing the amount of each oil exiting the tip in one minute intervals with no ultrasound, 20% Ultrasound, and 30% Ultrasound; however, because application of the ultrasound produced atomization of the oil streams, a bent piece of tubing was placed at the exit of the tip to allow for condensation of the oils. Some pictures were taken of the atomized stream. Results from each trial with each oil are reported in Tables 2 and 3.

TABLE 2

| | EP Hydraulic Oil 68 | | | | | | | |
|---|---|---|---|---|---|---|---|---|
| | No Ultrasound | | 20% Ultrasound | | | 30% Ultrasound | | |
| Press. (PSIG) | Flow (g/min) | Temp (deg F.) | Flow (g/min) | Temp (deg F.) | Power (Watts) | Flow (g/min) | Temp (deg F.) | Power (Watts) |
| | Capillary Tip diameter 0.006 inch, length 0.006 inch | | | | | | | |
| 200 | 33.48 | 87.9 | 28.48 | 93.7 | 65 | 28.16 | 105.8 | 100 |
| 300 | 46.28 | 90.1 | 34.84 | 96.4 | 65 | 35.24 | 106.7 | 100 |
| 400 | 45.32 | 74.4 | 38.56 | 84.5 | 95 | 35.36 | 93.9 | 110 |
| 500 | 54.80 | 85.8 | 41.68 | 94.2 | 100 | 43.12 | 106.1 | 135 |
| 600 | 63.20 | 89.7 | 47.76 | 98.2 | 105 | 48.24 | 111.2 | 150 |
| 700 | 69.32 | 87.8 | 62.16 | 89.0 | 65 | 55.72 | 104.9 | 180 |
| | Capillary Tip diameter 0.006 inch, length 0.010 inch | | | | | | | |
| 200 | 18.04 | 72.3 | 22.88 | 80.2 | 75 | 25.56 | 93.5 | 95 |
| 300 | 36.00 | 85.4 | 31.76 | 91.5 | 70 | 33.56 | 103.2 | 115 |
| 400 | 45.00 | 86.1 | 36.12 | 94.4 | 85 | 37.12 | 102.7 | 105 |
| 500 | 52.56 | 86.0 | 43.16 | 95.3 | 95 | 43.52 | 105.9 | 125 |
| 600 | 55.52 | 88.1 | 47.32 | 100.4 | 110 | 48.44 | 113.7 | 150 |
| 700 | 70.12 | 91.2 | 63.88 | 91.5 | 60 | 49.28 | 111.7 | 185 |
| | Capillary Tip diameter 0.004 inch, length 0.006 inch | | | | | | | |
| 200 | 24.64 | 69.9 | 34.32 | 80.9 | 75 | 34.00 | 100.9 | 90 |
| 300 | 30.88 | 89.2 | 53.64 | 101.1 | 80 | 57.40 | 105.9 | 120 |
| 400 | 38.88 | 91.0 | 28.64 | 82.4 | 120 | 30.60 | 97.5 | 170 |
| 500 | 41.08 | 93.3 | 32.88 | 108.8 | 115 | 31.92 | 133.3 | 215 |
| 600 | 46.64 | 88.8 | 33.04 | 111.0 | 90 | 33.76 | 138.2 | 120 |
| 700 | 48.20 | 98.2 | 35.60 | 123.9 | 100 | 57.36 | 140.7 | 140 |

TABLE 3

| | EP Hydraulic Oil 32 | | | | | | | |
|---|---|---|---|---|---|---|---|---|
| | No Ultrasound | | 20% Ultrasound | | | 30% Ultrasound | | |
| Press. (PSIG) | Flow (g/min) | Temp (deg F.) | Flow (g/min) | Temp (deg F.) | Power (Watts) | Flow (g/min) | Temp (deg F.) | Power (Watts) |
| | Capillary Tip diameter 0.006 inch, length 0.006 inch | | | | | | | |
| 200 | 42.92 | 88.7 | 31.52 | 94.8 | 65 | 31.88 | 104.9 | 90 |
| 300 | 53.84 | 86.7 | 38.60 | 91.4 | 55 | 39.84 | 98.7 | 100 |
| 400 | 61.04 | 86.7 | 46.32 | 93.2 | 70 | 45.16 | 98.9 | 100 |
| 500 | 69.56 | 87.4 | 50.80 | 93.2 | 80 | 51.56 | 102.3 | 115 |
| 600 | 75.72 | 81.1 | 55.16 | 90.3 | 100 | 55.40 | 101.1 | 140 |
| 700 | 77.32 | 76.1 | 60.12 | 81.1 | 65 | 57.92 | 99.6 | 165 |
| | Capillary Tip diameter 0.006 inch, length 0.010 inch | | | | | | | |
| 200 | 29.80 | 69.8 | 25.80 | 73.2 | 50 | 25.48 | 78.8 | 110 |
| 300 | 42.44 | 78.0 | 35.00 | 83.4 | 65 | 34.32 | 95.3 | 100 |
| 400 | 51.36 | 75.5 | 40.24 | 85.6 | 90 | 39.20 | 95.0 | 100 |
| 500 | 60.24 | 81.8 | 44.80 | 90.1 | 95 | 44.08 | 102.7 | 125 |
| 600 | 67.28 | 84.0 | 47.96 | 94.2 | 105 | 49.44 | 106.3 | 150 |
| 700 | 74.64 | 86.0 | 60.84 | 93.7 | 120 | 55.52 | 109.2 | 160 |
| | Capillary Tip diameter 0.006 inch, length 0.006 inch | | | | | | | |
| 200 | 18.04 | 69.8 | 20.56 | 77.1 | 60 | 22.88 | 86.5 | 90 |
| 300 | 31.60 | 83.6 | 27.28 | 91.9 | 65 | 27.72 | 102.3 | 100 |
| 400 | 37.72 | 88.5 | 30.88 | 98.7 | 80 | 32.76 | 105.8 | 100 |
| 500 | 45.28 | 90.6 | 37.16 | 99.1 | 85 | 37.40 | 109.2 | 120 |
| 600 | 48.16 | 92.4 | 41.72 | 101.3 | 100 | 88.56* | 100.4 | 110 |

*A sudden flow increase was noted during this trial. A microscopic examination of the tip revealed an enlargement. The enlargement did not appear to be caused by erosion. Instead, it appeared to be stress-related.

Results

Figure 2:
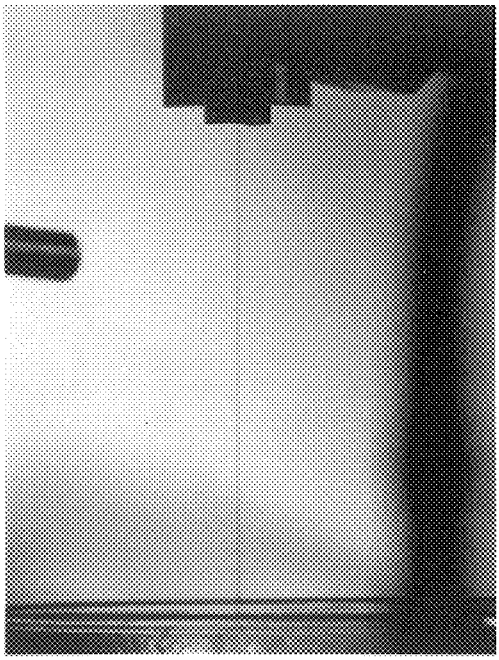
FIG. 2 is a photograph of a coherent oil stream.
Figure 3:
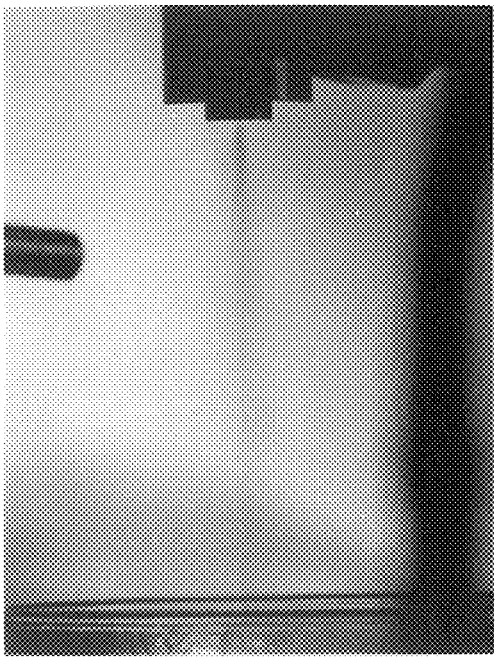
FIG. 3 is a photograph of an exemplary spray of liquid produced by an ultrasonic apparatus.

In every trial when the ultrasonic device was powered, the oil stream instantly atomized into a uniform, cone-shaped spray of fine droplets. FIG. 2 is a photograph of EP Hydraulic Oil 32 passing through the exit orifice of the ultrasonic apparatus at a pressure of 200 psig with no applied ultrasonic energy. The oil is in the form of a coherent stream. FIG. 3 is a photograph of EP Hydraulic Oil 32 passing through the exit orifice of the ultrasonic apparatus at a pressure of 200 psig with ultrasonic energy applied at a rate of 20 percent of available power, as indicated by the Branson power controller. Note that the oil is in the form of a uniform, cone-shaped spray of atomized oil droplets. The exit orifice of the apparatus shown in both FIGS. 2 and 3 has a diameter of 0.010 inch and a length of 0.010 inch.

Figure 4:
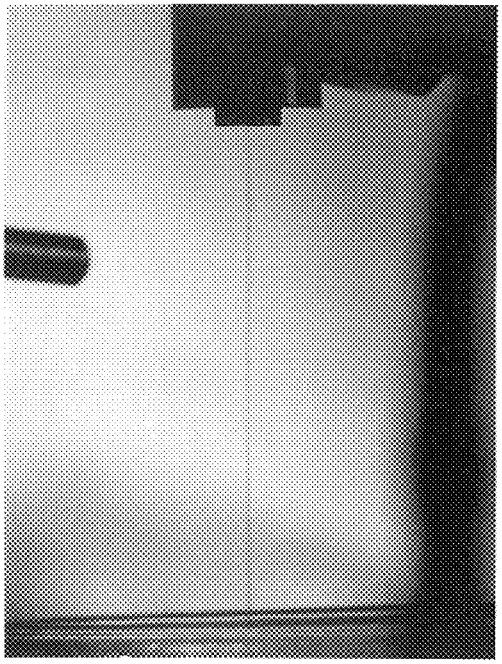
FIG. 4 is a photograph of a coherent oil stream.
Figure 5:
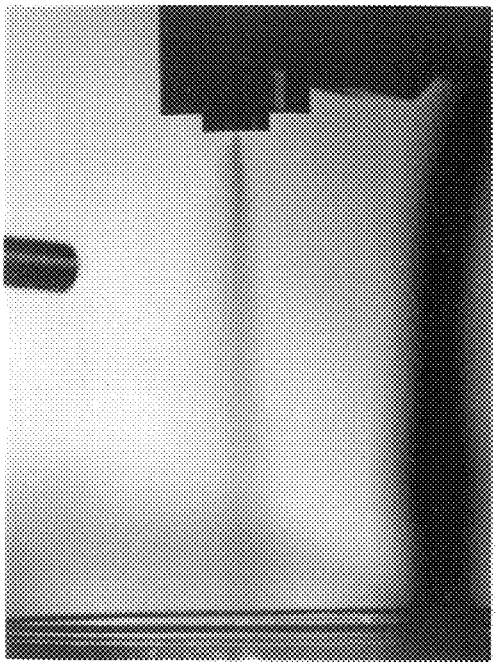
FIG. 5 is a photograph of an exemplary spray of liquid produced by an ultrasonic apparatus.

FIG. 4 is a photograph of EP Hydraulic Oil 32 passing through the exit orifice of the ultrasonic apparatus at a pressure of 500 psig with no applied ultrasonic energy. The oil is in the form of a coherent stream. FIG. 5 is a photograph of EP Hydraulic Oil 32 passing through the exit orifice of the ultrasonic apparatus at a pressure of 500 psig with ultrasonic energy applied at a rate of 20 percent of available power, as indicated by the Branson power controller. Note that the oil is in the form of a uniform, cone-shaped spray of atomized oil droplets. The exit orifice of the apparatus shown in both FIGS. 4 and 5 has a diameter of 0.010 inch and a length of 0.010 inch.

Related Applications

This application is one of a group of commonly assigned patent applications which are being filed on the same date. The group includes application Ser. No. 08/576,543 entitled "An Apparatus And Method For Emulsifying A Pressurized Multi-Component Liquid", Docket No. 12535, in the name of L. K. Jameson et al.; application Ser. No. 08/576,536 entitled "An Apparatus And Method For Ultrasonically Producing A Spray Of Liquid", Docket No. 12536, in the name of L. H. Gipson et al.; application Ser. No. 08/576,522 entitled "Ultrasonic Fuel Injection Method And Apparatus", Docket No. 12537, in the name of L. H. Gipson et al.; application Ser. No. 08/576,174 entitled "An Ultrasonic Apparatus And Method For Increasing The Flow Rate Of A Liquid Through An Orifice", Docket No. 12538, in the name of B. Cohen et al.; and application Ser. No. 08/576,175 entitled "Ultrasonic Flow Control Apparatus And Method", Docket No. 12539, in the name of B. Cohen et al. The subject matter of these applications is hereby incorporated by reference.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An apparatus for ultrasonically producing a spray of liquid, the apparatus comprising:

means for pressurizing a liquid to a pressure of at least 100 psig;

a die housing defining:

a chamber adapted to receive said pressurized liquid;

an inlet in communication with said liquid pressurizing means and adapted to supply the chamber with the pressurized liquid;

an exit orifice defined by the walls of a die tip, the exit orifice being adapted to receive the pressurized multi-component liquid from the chamber and pass the liquid out of the die housing under pressure;

said die tip comprising a nozzle with walls converging to the exit orifice; and a means for applying ultrasonic energy to a portion of the pressurized liquid within the chamber without applying ultrasonic energy to the die tip, said means for applying ultrasonic energy being located within the chamber, wherein only one exit orifice is required to produce a conical spray-pattern of liquid when the means for applying ultrasonic energy is excited with ultrasonic energy while the exit orifice receives pressurized liquid from the chamber and passes the pressurized liquid out of the die housing.

2. The apparatus of claim 1, wherein the exit orifice is self-cleaning.

3. The apparatus of claim 1, wherein the means for applying ultrasonic energy is an immersed magnetostrictive ultrasonic horn.

4. The apparatus of claim 1, wherein the apparatus is adapted to produce an atomized spray of liquid.

5. The apparatus of claim 1, wherein the exit orifice is a single exit orifice.

6. The apparatus of claim 1, wherein the exit orifice has a diameter of from about 0.0001 to about 0.1 inch.

7. The apparatus of claim 6, wherein the exit orifice has a diameter of from about 0.001 to about 0.01 inch.

8. The apparatus of claim 1, wherein the exit orifice is an exit capillary.

9. The apparatus of claim 8, wherein the exit capillary has a length to diameter ratio of from about 4:1 to about 10:1.

10. The apparatus of claim 1, wherein the ultrasonic energy has a frequency of from about 15 kHz to about 500 kHz.

11. An apparatus for ultrasonically producing a spray of liquid, the apparatus comprising:

means for pressurizing a liquid to a pressure of at least 100 psig;

a die housing having a first end and a second end and defining:

a chamber adapted to receive a pressurized liquid;

an inlet in communication with said liquid pressurizing means and adapted to supply the chamber with the pressurized liquid;

an exit orifice defined by the walls of a die tip, the exit orifice being located in the first end of the die housing and adapted to receive the pressurized liquid from the chamber and pass the liquid out of the die housing under pressure along a first axis, said die tip comprising a nozzle with walls converging to the exit orifice; and an ultrasonic horn having a first end and a second end and adapted, upon excitation by ultrasonic energy, to have a node and a longitudinal mechanical excitation axis, the horn being located in the second end of the die housing in a manner such that the first end of the horn is located outside the die housing and the second end of the horn is located inside the die housing, within the chamber, and is in close proximity to the exit orifice but does not apply ultrasonic energy to the die tip, wherein only one exit orifice is required to produce a pressurized conical spray-pattern of liquid when the ultrasonic horn is excited with ultrasonic energy while the exit orifice receives pressurized liquid from the chamber and passes the pressurized liquid out of the die housing.

12. The apparatus of claim 11, wherein the apparatus is adapted to produce an atomized spray of liquid.

13. The apparatus of claim 11, wherein the ultrasonic horn is an immersed magnetostrictive ultrasonic horn.

14. The apparatus of claim 11, wherein the ultrasonic horn has coupled to the first end thereof a vibrator means as a source of longitudinal mechanical excitation.

15. The apparatus of claim 11, wherein the ultrasonic energy has a frequency of from about 15 kHz to about 500 kHz.

16. The apparatus of claim 11, wherein the longitudinal mechanical excitation axis is substantially parallel with the first axis.

17. The apparatus of claim 14, wherein the vibrator means is a piezoelectric transducer.

18. A method of ultrasonically producing a spray of liquid, the method comprising:

supplying a liquid at a pressure of at least 100 psig to a die assembly, the die assembly being composed of:

a die housing comprising:

a chamber adapted to receive said pressurized liquid;

an inlet adapted to supply the chamber with the pressurized liquid;

an exit orifice defined by the walls of a die tip, the exit orifice being adapted to receive the pressurized liquid from the chamber and pass the multi-component liquid out of the die housing under pressure, said die tip comprising a nozzle with walls converging to the exit orifice; and a means for applying ultrasonic energy to a portion of the pressurized liquid within the chamber;

exciting the means for applying ultrasonic energy with ultrasonic energy while the exit orifice receives said pressurized liquid from the chamber, without applying ultrasonic energy to the die tip, and passing the pressurized liquid as a spray of liquid out of the exit orifice in the die tip, wherein only one exit orifice is required to produce a conical spray pattern of liquid when the means for applying ultrasonic energy is excited with ultrasonic energy while the exit orifice receives said pressurized liquid from the chamber and passes the liquid out of the die housing as a spray of liquid.

19. The method of claim 18 wherein the means for applying ultrasonic energy is located within the chamber.

20. The method of claim 19, Wherein the means for applying ultrasonic energy is an immersed magnetostrictive ultrasonic horn.

21. The method of claim 18, wherein the exit orifice is an exit capillary.

22. The method of claim 18, wherein the ultrasonic energy has a frequency of from about 15 kHz to about 500 kHz.

23. The method of claim 18, wherein the ultrasonic energy has a frequency of from about 15 kHz to about 60 kHz.

24. The method of claim 18, wherein the steps of exciting the means for applying ultrasonic energy with ultrasonic energy while the exit orifice receives pressurized liquid from the chamber and passing the liquid out of the exit orifice in the die tip further includes the step of self-cleaning the exit orifice.

25. The method of claim 18, wherein the spray of liquid is an atomized spray of liquid.

26. A method of ultrasonically producing a spray of liquid, the method comprising:

supplying a liquid at a pressure of at least 100 psig to a die assembly composed of:

a die housing comprising:

a chamber adapted to receive the pressurized liquid; the chamber having a first end and a second end;

an inlet adapted to supply the chamber with the pressurized liquid; and an exit orifice defined by walls in a die tip and located in the first end of the chamber and adapted to receive the pressurized liquid from the chamber and pass the liquid out of the die housing under pressure along a first axis, said die tip comprising a nozzle with walls converging to the exit orifice; and an ultrasonic horn having a first end and a second end and adapted, upon excitation by ultrasonic energy, to have a node and a longitudinal mechanical excitation axis, the horn being located in the second end of the chamber in a manner such that the first end of the horn is located outside of the chamber and the second end of the horn is located within the chamber and is in close proximity to the extrusion orifice;

exciting the ultrasonic horn with ultrasonic energy while the exit orifice receives said pressurized liquid from the chamber and without applying ultrasonic energy to the die tip; and passing the liquid as a spray of liquid out of the exit orifice in the die tip;

wherein only one exit orifice is required to produce a conical spray-pattern of liquid when the means for applying ultrasonic energy is excited with ultrasonic energy while the exit orifice receives the pressurized liquid from the chamber and passes the pressurized liquid out of the die housing as spray of liquid.

27. The method of claim 26, wherein the exit orifice is an exit capillary.

28. The method or claim 26, wherein the ultrasonic energy has a frequency of from about 15 kHz to about 500 kHz.

29. The method of claim 26, wherein the spray of liquid is an atomized spray of liquid.

30. An apparatus for ultrasonically producing a spray of liquid, the apparatus comprising:

means for pressurizing a liquid to a pressure of at least 100 psig;

a die housing defining:

a chamber adapted to receive said pressurized liquid;

an inlet in communication with said liquid pressurizing means and adapted to supply the chamber with the pressurized liquid; and an exit orifice defined by the walls of a die tip, the exit orifice being adapted to received the pressurized liquid from the chamber and pass the liquid out of the die housing under pressure; and a means for applying ultrasonic energy to a portion of the pressurized liquid within the chamber without applying ultrasonic energy to the die tip, said means for applying ultrasonic energy being located within the chamber wherein the means for applying ultrasonic energy is an immersed ultrasonic horn;

wherein only one exit orifice is required to produce a conical spray-pattern of liquid when the means for applying ultrasonic energy is excited while the exit orifice receives the pressurized liquid from the chamber and passes the pressurized liquid out of the die housing.

31. The apparatus of claim 30, wherein the means for applying ultrasonic energy is an immersed magnetostrictive ultrasonic horn.

32. The apparatus of claim 30, wherein the exit orifice has a diameter of from about 0.0001 to about 0.1 inch.

33. The apparatus of claim 32, wherein the exit orifice has a diameter of from about 0.001 to about 0.01 inch.

34. The apparatus of claim 30, wherein the exit orifice is an exit capillary.

35. The apparatus of claim 34, wherein the exit capillary has a length to diameter ratio of from about 4:1 to about 10:1.

36. The apparatus of claim 30, wherein the ultrasonic energy has a frequency of from about 15 kHz to about 500 kHz.

37. The apparatus of claim 30, wherein the exit orifice is self-cleaning.

38. The apparatus of claim 30, wherein the apparatus is adapted to produce an atomized spray of liquid.

* * * * *